US006028276A

United States Patent [19]

Takano et al.

[11] Patent Number: 6,028,276

[45] Date of Patent: Feb. 22, 2000

[54] SWITCH MOUNTING STRUCTURE

[75] Inventors: Tsunesuke Takano; Hiroshi Yabata; Takeshi Sato, all of Tokyo, Japan

[73] Assignee: Kabushiki Kaisha T AN T, Japan

[21] Appl. No.: 09/318,617

[22] Filed: May 26, 1999

[30] Foreign Application Priority Data

Jun. 3, 1998 [JP] Japan ..... 10-154348

[51] Int. Cl.[7] ..... H01H 9/08

[52] U.S. Cl. ..... 200/295

[58] Field of Search ..... 200/293–297, 200/302.1–303, 307; 361/679, 728, 729, 730, 732, 807, 809, 810, 837

[56] References Cited

U.S. PATENT DOCUMENTS 4,715,569 12/1987 Essig et al. ..... 248/27.1
4,843,198 6/1989 Lichtenberger ..... 200/61.86
5,256,841 10/1993 Zanella ..... 200/296
5,350,140 9/1994 Ripley et al. ..... 248/27.1

*Primary Examiner*—Michael Friedhofer
*Attorney, Agent, or Firm*—Nixon & Vanderhye P.C.

[57] ABSTRACT

Switch mounting structures have a generally rectangular body switch with oppositely extending planar base extensions, and a housing which defines a pair of spaced-apart slotted mounting entries to receive respective terminal edge portions of a respective one of the base extensions. The terminal edge portions of the base extensions include diagonally opposed pairs of coved portions and recesses, while the housing includes a pair of diagonally opposed proturbences. These proturbences are engaged with said diagonally opposed pair of recesses when said base extensions are rotated relative to said housing from an initial insertion position, where the base extensions are in a slanted orientation relative to the mounting entries, and a mounted position, where the base extensions are in a non-slanted orientation relative to the mounting entries. In such a manner, the switch body and the housing are brought lockable engagement with one another.

6 Claims, 9 Drawing Sheets

SWITCH MOUNTING STRUCTURE

BACKGROUND OF THE INVENTION

The present invention relates to a switch mounting structure in which a switch for turning on or off automotive indoor lights such as the room lamp attached to the middle portion of the roof of the automobile room, the map lamp provided forwardly of the driver's seat or the like is readily, without the use of screws or the like, mounted to the housing in which said lights are accommodated.

The map lamp is taken, as an example, out of automotive indoor lights with reference to FIG. 9 and FIG. 10.

A housing 1 of synthetic resin has a lamp 2 mounted therein with a transparent or translucent lens 3 being secured to the front thereof. Said housing 1 has a push switch 4 (hereinafter referred to simply as a switch) mounted for turning on or off said lamp 2, said switch 4 having a base extension 41 secured thereto by means of screws 5 to a platform 11 integrally formed in one longitudinal portion of said housing 4. A switch button 6 is fitted to the lever 42 of the switch 4 such that the housing may be operated from the front side.

The terminal (not shown) of the thus constructed switch 4 is electrically connected between the power source (or the automotive battery) and said lamp 2 such that said switch 4 takes an ON position to turn on the lamp 2 when the switch button 6 is pressed and an Off position to turn off the lamp 2 when said button 6 is pressed again.

Thus, said switch 4 has problems such as the need for screw tightening work at the time of assembly thereof during the manufacture, incurring an expensive investment cost in equipment such as a nut runner in addition to a troublesome and time consuming operation such as a screw tightening work with the result that the increase in the manufacturing cost is involved.

SUMMARY OF THE INVENTION

The present invention is intended to solve said problems and its object is to provide a switch mounting structure in which the switch is inserted into the housing and secured therein merely by being rotated to eliminate the need for investment in equipment and to reduce the manufacturing cost due to the simplified operation.

The present invention is made to achieve the objects described in the foregoing and its means includes a switch composed of a generally rectangular body having a pair of base extensions on both sides thereof, each base extension being formed with first engagement means; and a housing formed with raised portions having entries to allow insertion thereinto of said base extensions of the switch as held co-planarly with said housing, said raised base portions having second engagement means formed to engage with said first engagement means, said second engagement means being complementary to said first engagement means, said first and second engagement means being arranged diagonally in contraposition.

DETAILED DESCRIPTION OF THE EMBODIMENTS

Figure 1:
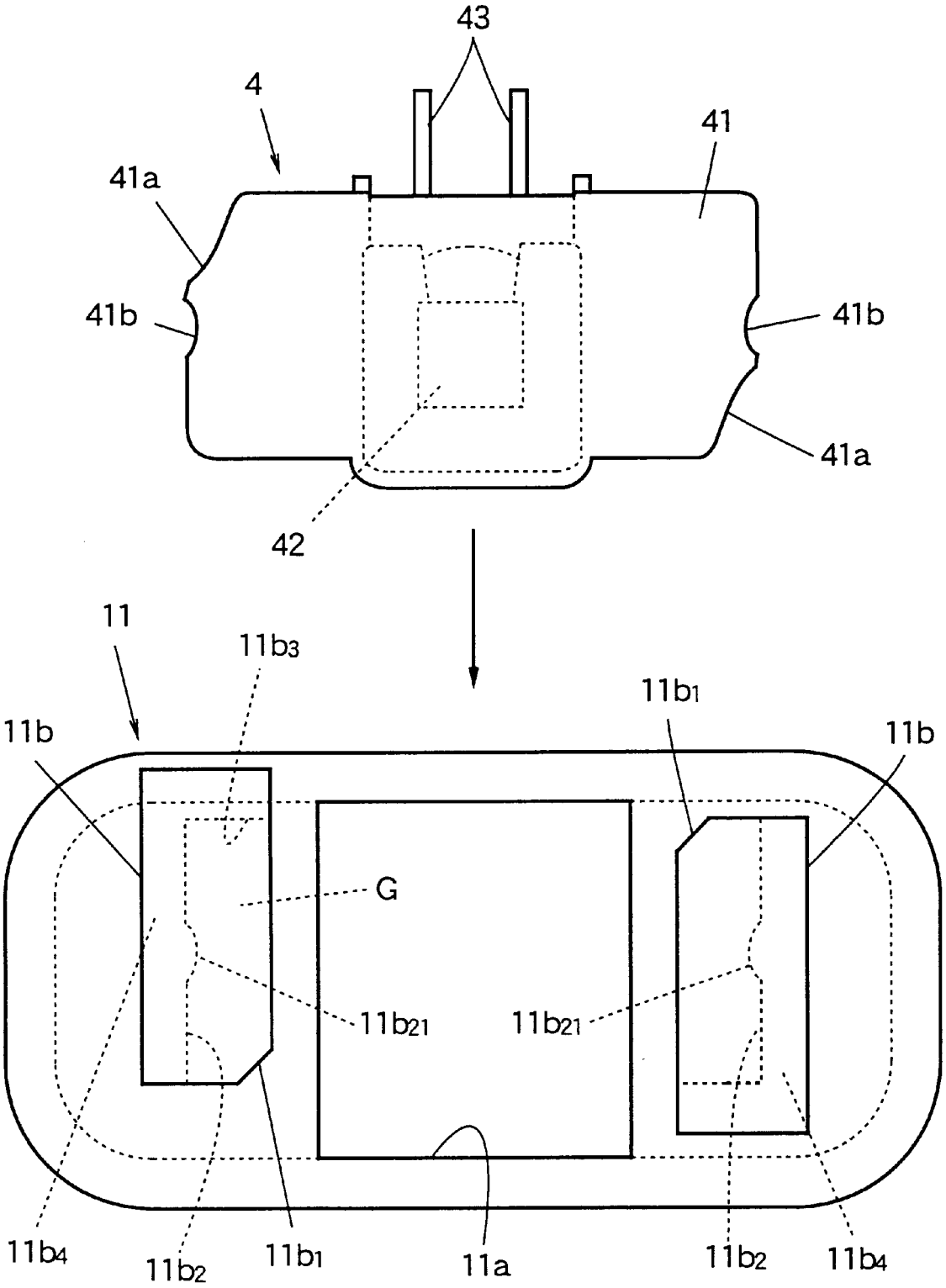
FIG. 1 is a plan view showing the major portions of the switch and the raised portions in the first embodiment of the present invention directed to a switch mounting structure.
Figure 2:
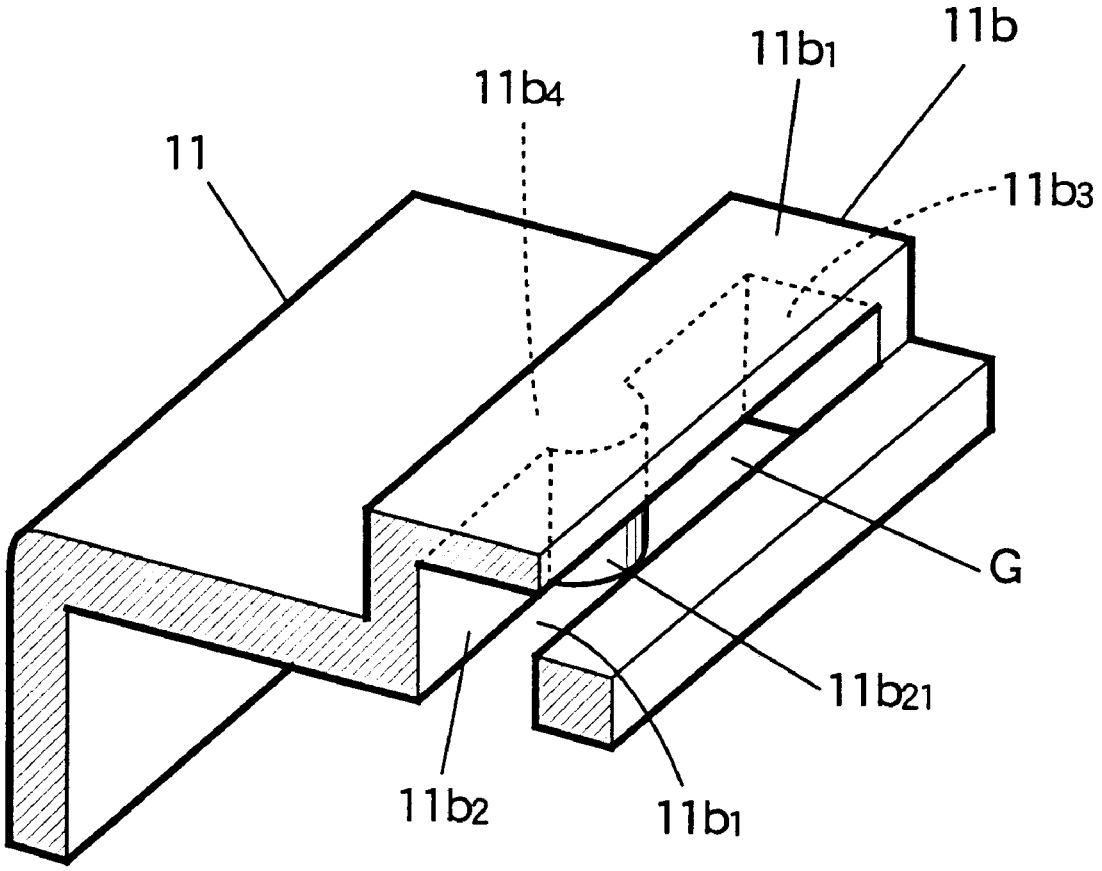
FIG. 2 is a partially cut-out cross sectional view of the raised portion in FIG. 1.

Hereinafter, the first embodiment of the invention directed to the switch mounting structure will be explained with reference to FIGS. 1 through 4. In this connection, the explanation of similar numbers and characters to those used in that of the prior art will be omitted.

The difference of the present invention from the prior art is the change in the structures such as the shape of the base extension 41 of the switch 4 and the structure of the platform 11 of the housing 1.

More specifically, said switch 4 is composed of a generally rectangular body, at the center portion of which a switch body is provided to descend such that both side thereof extends in the form of a pair of base extensions 41, the longitudinal end of each base extension 41 of the switch 4 has opposite two corners, one of said opposite two corners being cut off to be less distant from the center of the body of said switch 4 per se than the other and formed with a coved portion 41*a* in said cut-off portion. Further, the central portions of the longitudinal ends of said base extensions 41 have semi-circular recesses 41*b*. Thus, said coved portions 41*a* and said semi-circular recesses 41*b* are arranged diagonally in contraposition.

Then, the numeral 43 in the figure denotes terminals to connect the power source to the lamps while a lever 42 provided in the reverse side in the figure is shown by a dotted line.

On the other hand, the platform 11 in the housing 1 is similarly rectangular in plan view to form a substantially rectangular parallelepiped. The platform 11 of said housing 1 is formed at the center portion thereof with an opening 11*a* for allowing the body of the switch 4 to be nested thereinto. Further, raised base portions 11*b* are formed in said platform 11 of the housing on opposite sides of said opening 11*a*, each raised portion 11*b* having a cavity G defined by a ceiling wall $\mathbf{11}b_1$, a lateral upright wall $\mathbf{11}b_2$, and an upright longitudinal wall $\mathbf{11}b_3$ to allow insertion thereinto of the longitudinal ends of said base extension 41 of the switch 4 through an entry $\mathbf{11}b_4$ into each cavity G. Further, a semi-circular protuberance $\mathbf{11}b_{21}$ is formed in said lateral upright wall $\mathbf{11}b_2$ to fit into said semi-circular recess 41*b* in the base extension 41 of said switch 4.

Said entries $\mathbf{11}b_4$ in the opposite raised base portions 11*b* are arranged diagonally in contraposition about the center of the switch 4 per se. Then, with the body of the switch 4 being nested into said opening 11*a*, the opposite longitudinal ends of said base extensions take a slantwise position to be allowed into said entries $\mathbf{11}b_4$.

Figure 3:
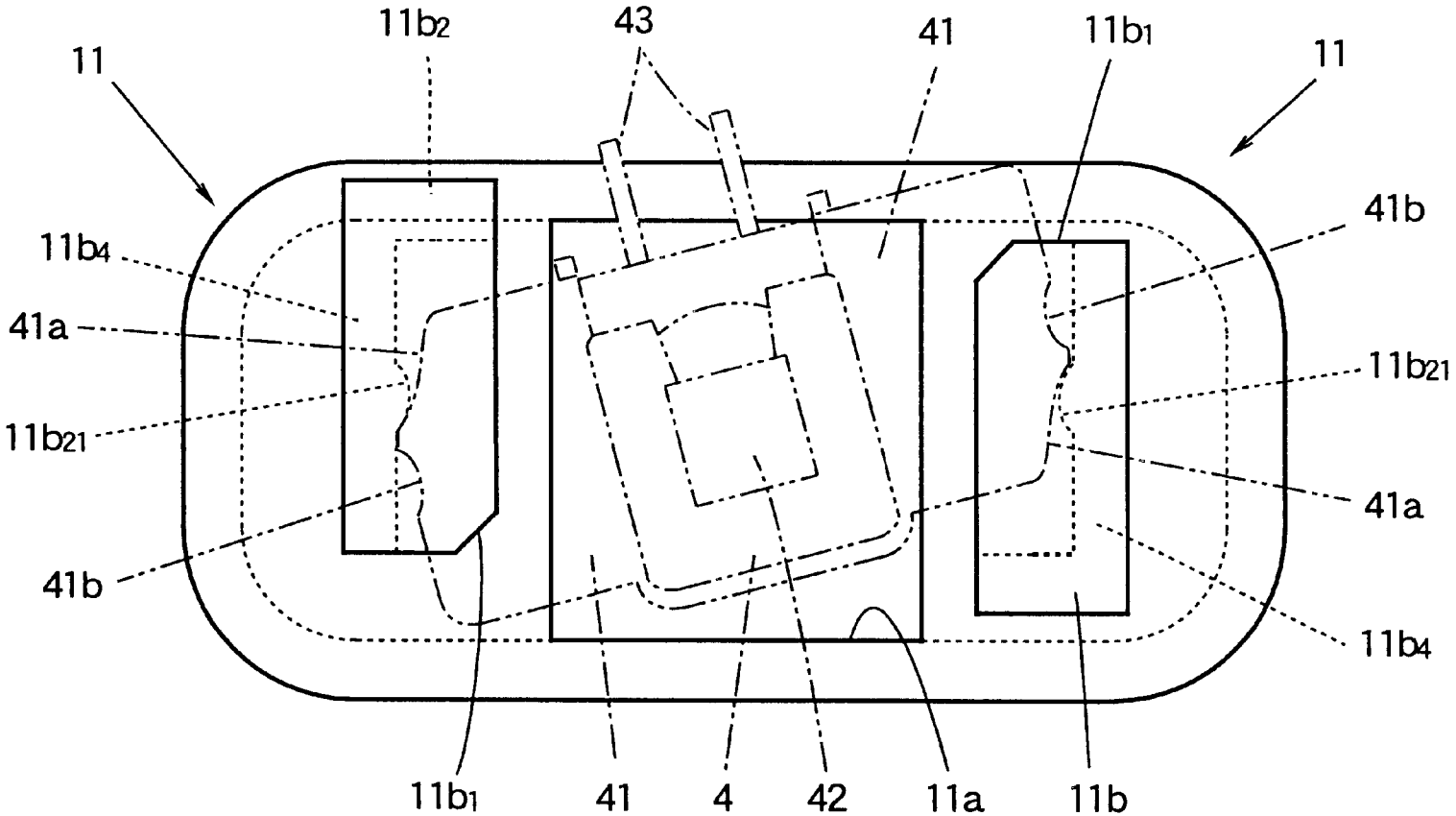
FIG. 3 is a plan view showing the process of mounting the switch onto the housing.
Figure 4:
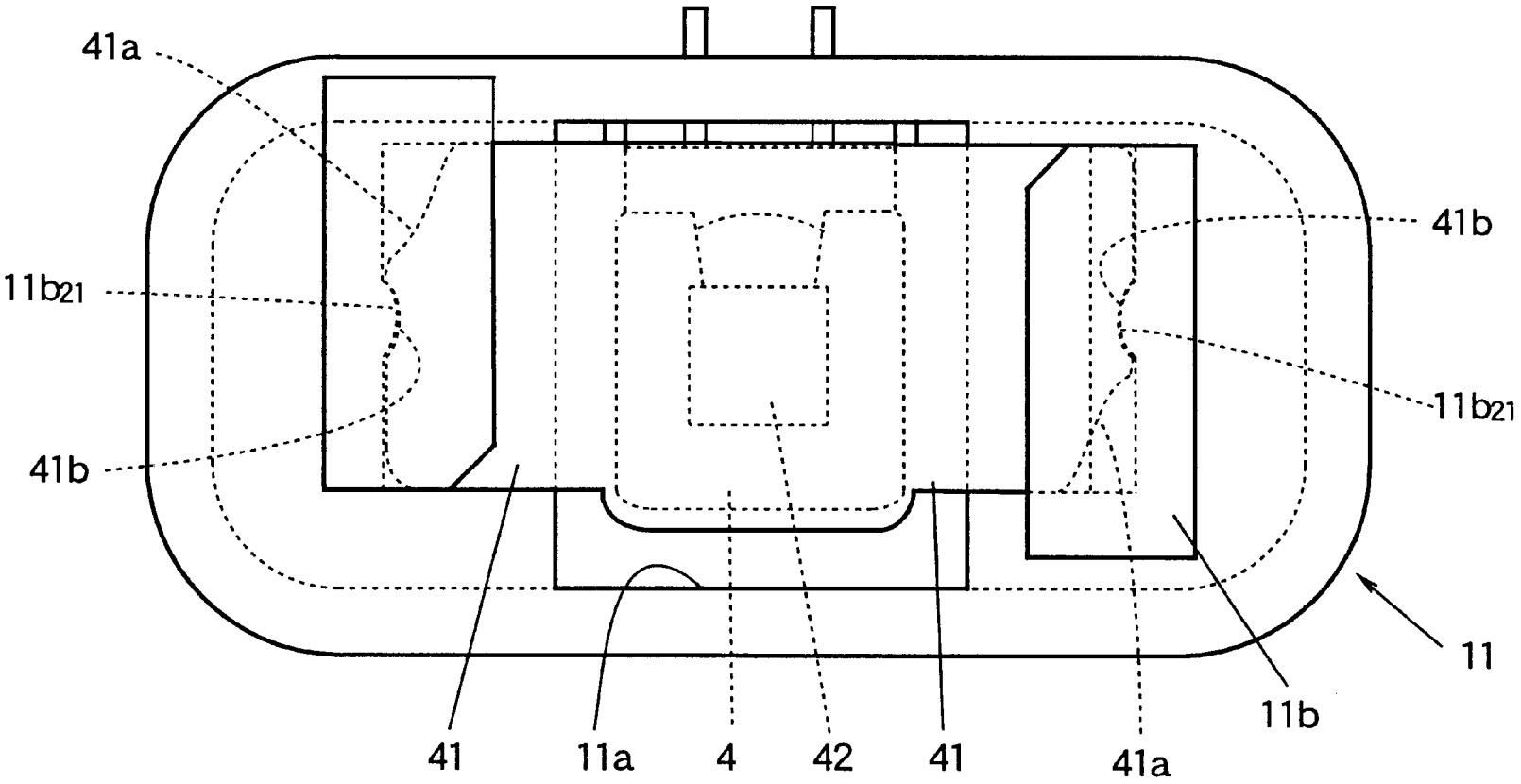
FIG. 4 is a plan view showing the completion of the mounting work.
Figure 5:
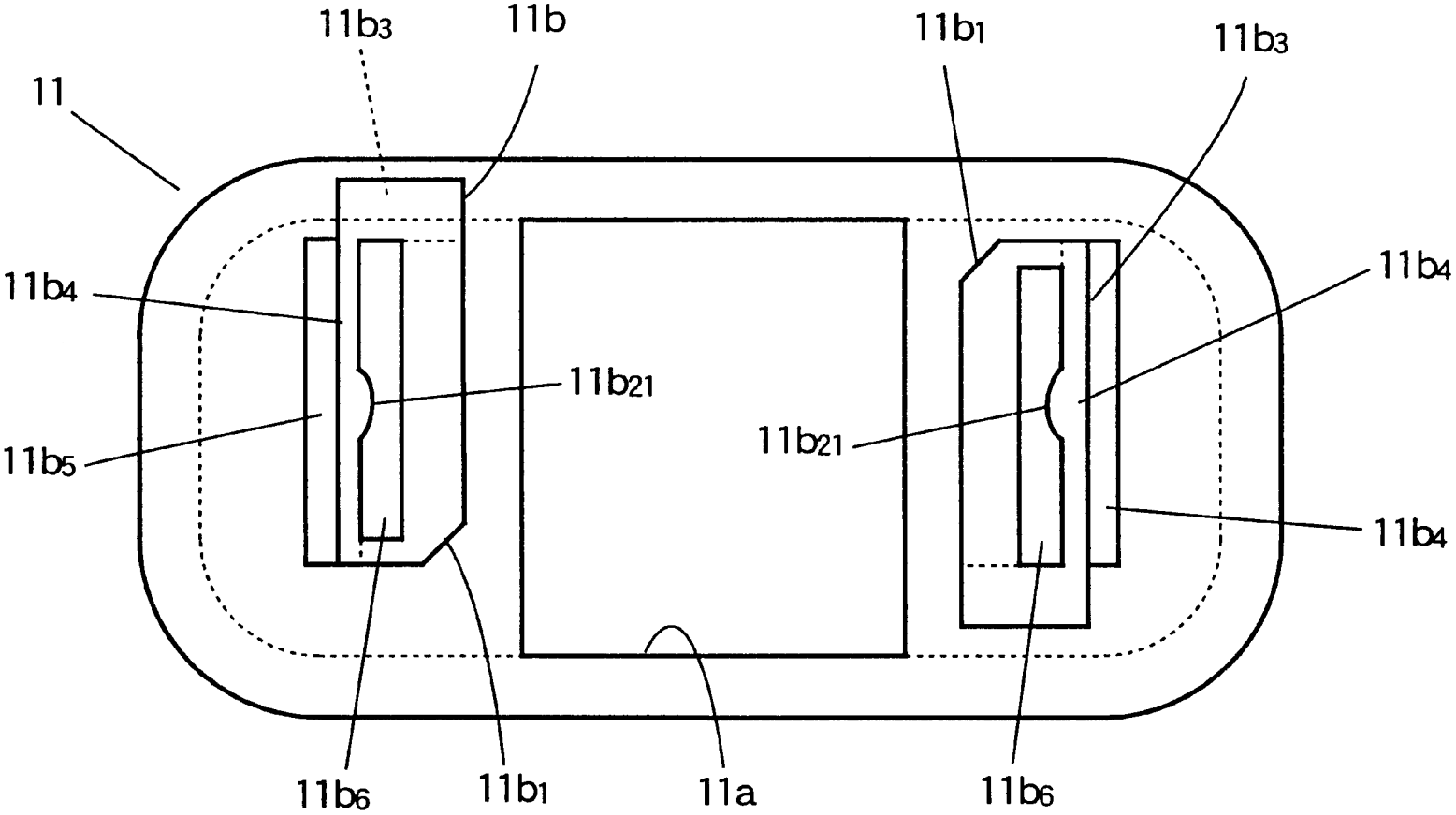
FIG. 5 is a plan view of the raised portion of the second embodiment of the invention.
Figure 6:
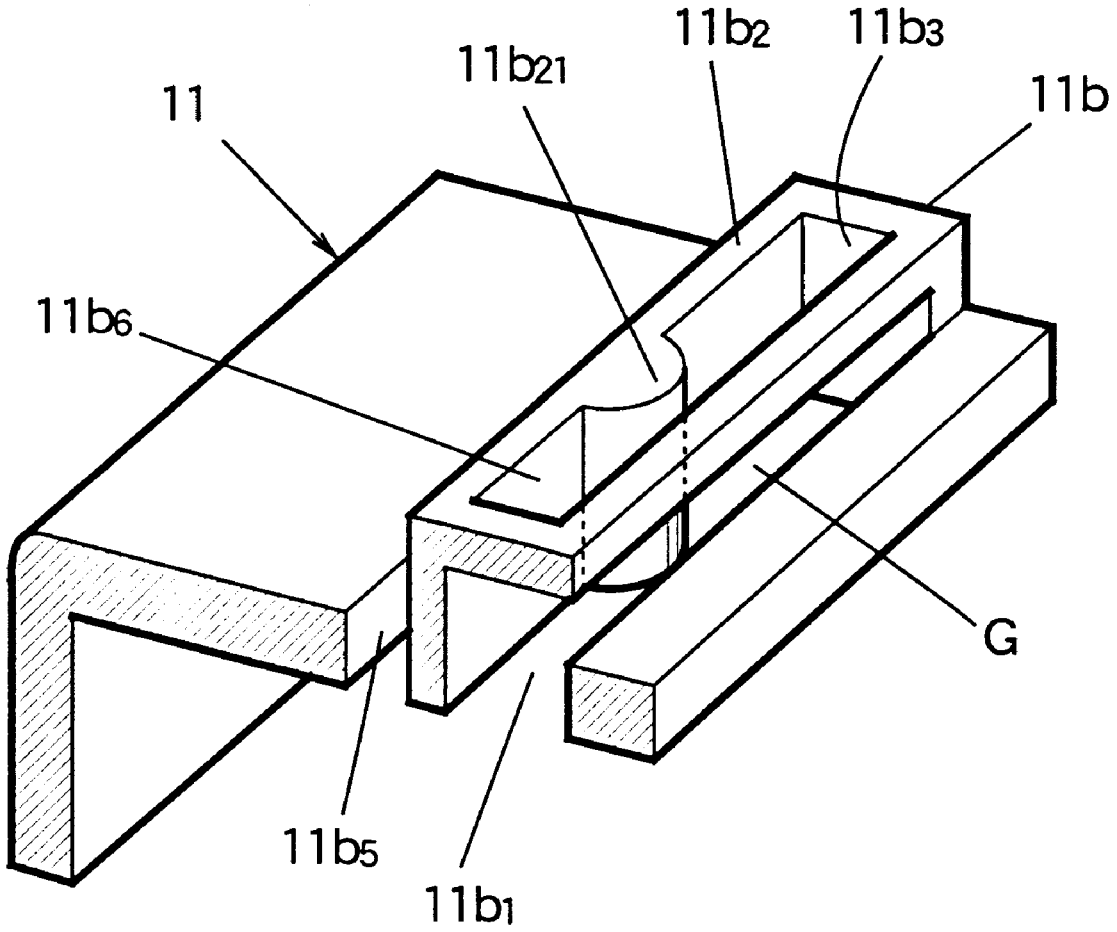
FIG. 6 is a partially cut-out cross sectional view thereof in FIG. 5.
Figure 7:
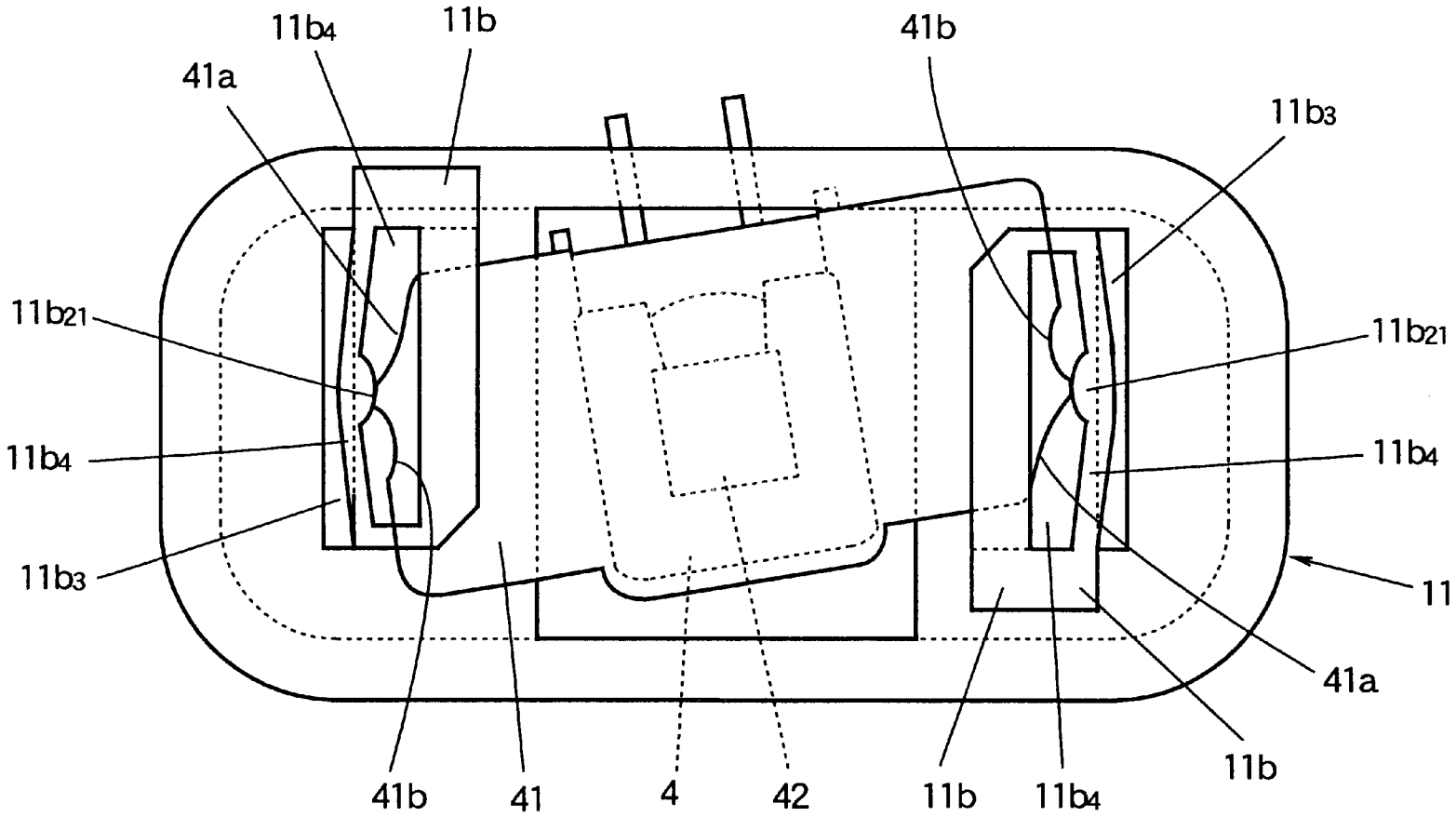
FIG. 7 is a plan view showing the process of mounting the switch to the housing.
Figure 8:
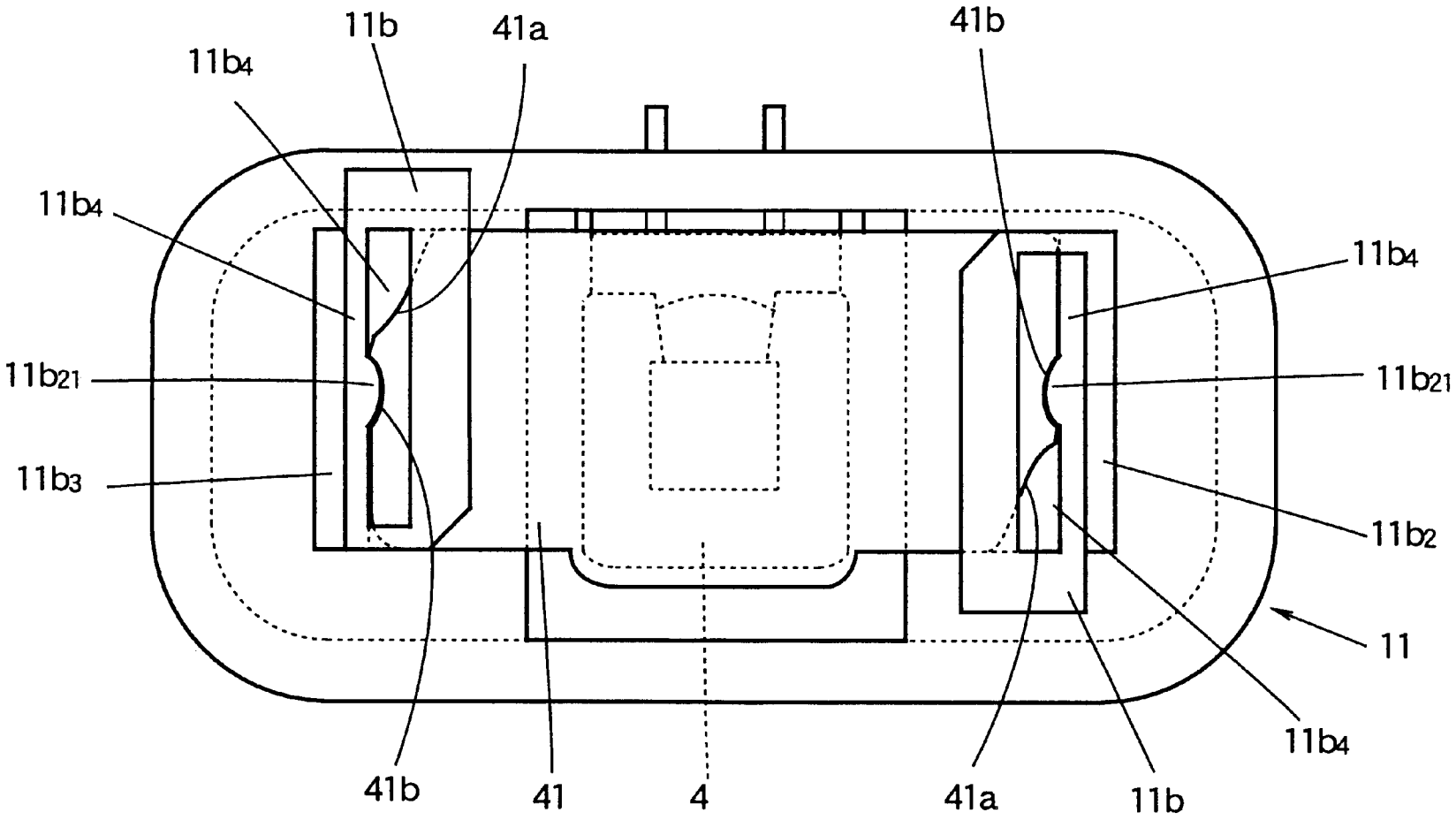
FIG. 8 is a plan view showing the assembled state.
Figure 9:
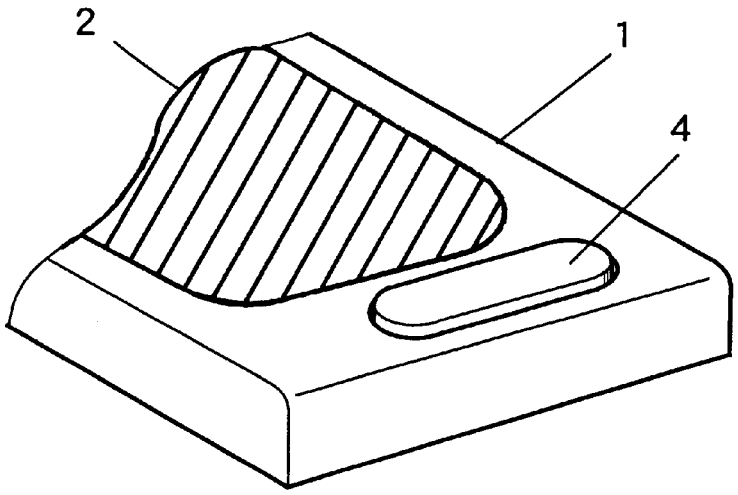
FIG.9 (Prior Art)
FIG. 9 is a perspective view taken from the bottom side thereof to show the switch portion of the automotive indoor room lights in the prior art.
Figure 10:
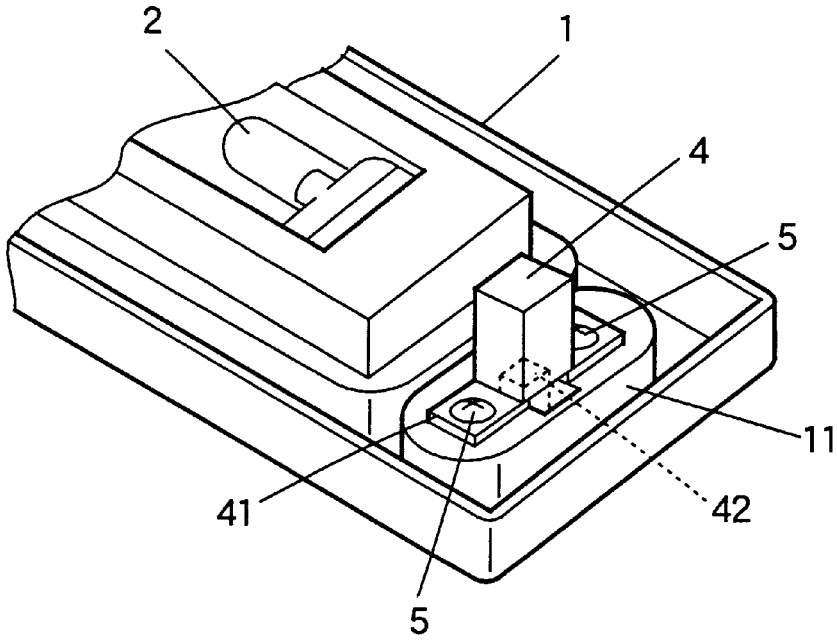
FIG.10 (Prior Art)
FIG. 10 is a perspective view of the same taken from the front.

More specifically, a method of mounting said switch 4 to the raised base portions 11*b* of the platform 11 of the housing 1 will be explained with reference to FIG. 3 and FIG. 4 showing the structure described in the foregoing.

First of all, the switch 4 is generally held coplanarly with the housing 1 such that the body of the switch 4 per se is nested into the opening 11*a* with the lever (not shown) being provided at the underside thereof and with the opposite longitudinal ends of said base extensions taking a slantwise position as shown in FIG. 3 and mentioned in the foregoing.

Next, the longitudinal ends of the base extensions 41 of the switch 4 is swung clockwise while holding the switch 4 co-planary with said housing 1 to insert the same into the entries $11b_1$. At this time, the boundary portions between the coved portions 41*a* and the recesses 41*b* in the base extensions 41 are brought into contact with the protuberances $11b_{21}$. Since the housing 1 is made of synthetic resin, the forced pressing action causes a slight change in the shape of the protuberances $11b_{21}$, thus allowing the same to override and pass said boundary portion.

Thus, the recess 41*b* is brought into engagement with the protuberance $11b_{21}$ after the boundary portion has passed said protuberance $11b_{21}$, to provide a locked state as shown in FIG. 4. The locked state assures that the switch is prevented from unexpectedly slipping off out of the housing 1 while the ready mounting thereof is done without use of tightening means such as screws as in the prior art.

Next, the second embodiment of the invention will be explained with reference to FIGS. 5 through 8. The difference of this embodiment from the first embodiment is that a cutout $11b_5$ is formed between the lateral upright wall $11b_2$ having the protuberance $11b_{21}$, formed therein and the platform 11 and that a cutout $11b_6$ is formed in the top portion of the raised portions 11*b* such that the lateral upright wall $11b_2$ is adapted to be deformed due to said lateral wall $11b_2$ being given resiliency by such separation.

Thus constructed, the lateral wall $11b_2$ is subject to warp and deformation at the time when the boundary portion between the coved portion 41*a* and the recess 41*b* is brought into contact with said protuberance $11b_{21}$ with the result that said boundary portion passes said protuberance $11b_{21}$ with a weaker force sufficient to cause the switch to rotate the same into a locked position in which the recess 41*b* is brought into engagement with the protuberance $11b_{21}$, thus improving the work efficiency.

In any of the embodiment of the invention, the engagement of the base extensions 41 and the raised base portions 11*b* is explained by the relationship in which said base extensions 41 is formed with the recess 41*b* while the raised base 11*b* is formed with protuberance $11b_{21}$. However, this relationship of the recess and the protuberance may be reversed and said engagement means is not limited to such shapes.

The present invention realizes the cost reduction due to the improved work efficiency as a result of the omission of the tightening means such as screws and the need for fewer parts because a raised portion are formed in the housing such that the base extensions of the switch are inserted thereinto, said base extensions are held coplanarly and inserted into said raised base portions, and said switch is rotated to fit into secure engagement of said base extensions and said raised portions.

Further, the resiliency provided to the raised portions into which the base extensions are fit makes the engagement of said base extensions and said raised portions easy, thus contributing to the improvement of the work efficiency.

What is claimed is:

1. A switch mounting structure comprising:

a switch composed of a generally rectangular body having sides which include a pair of base extensions, each of said base extensions being formed with first diagonally opposed engagement structures; and a housing formed with raised base portions defining mounting entries to allow insertion thereto of said base extensions of the switch when the switch is in a co-planar orientation relative to said housing, said raised base portions having second diagonally opposed engagement structures; wherein said first and second engagement structures being engageable with one another in response to relative turning movement of said switch body and said housing when said base extensions are insertably received within said entries, whereby said switch body and said housing are locked to one another.

2. A switch mounting structure as set forth in claim 1, wherein said second engagement structures is provided with resiliency to allow deformation thereof at the time of engagement with said first engagement structures.

3. The switch mounting structure as set forth in claim 1, wherein said first engagement structures include a pair of diagonally opposed protuberances.

4. The switch mounting structure as set forth in claim 3, wherein said second engagement structures include a pair of semi-circular recesses which engage with said protuberances to thereby lock said body and housing to one another.

5. The switch mounting structure as set forth in claim 4, wherein said second engagement structures include diagonally opposed cove portions.

6. A switch mounting structure comprising:

a switch having a generally rectangular body with oppositely extending planar base extensions; and a housing which defines a pair of spaced-apart slotted mounting entries to receive respective terminal edge portions of a respective one of said base extensions; wherein said terminal edge portions of said base extensions include diagonally opposed pairs of coved portions and recesses, and wherein said housing includes a pair of diagonally opposed proturbences, said proturbences being engaged with said diagonally opposed pair of recesses when said base extensions are rotated relative to said housing from an initial insertion position, where the base extensions are in a slanted orientation relative to said mounting entries, and a mounted position, where the base extensions are in a non-slanted orientation relative to said mounting entries, whereby said switch body and said housing are lockable engaged to one another.

* * * * *